US005518123A

United States Patent [19]

Jin et al.

[11] Patent Number: 5,518,123

[45] Date of Patent: May 21, 1996

[54] APPARATUS FOR AUTOMATICLALY SORTING PERMANENT MAGNETS

[75] Inventors: Kyung S. Jin; Eun D. Lee; Ihn S. Min, all of Kyungki; Bae K. Kim, Seoul, all of Rep. of Korea

[73] Assignee: Lucky Metals Corporation, Seoul, Rep. of Korea

[21] Appl. No.: 254,975

[22] Filed: Jun. 7, 1994

[30] Foreign Application Priority Data

Dec. 29, 1993 [KR] Rep. of Korea ..... 30976/1993

[51] Int. Cl.[6] ..... B07C 5/344

[52] U.S. Cl. ..... 209/571; 209/907

[58] Field of Search ..... 209/571, 924, 209/907, 706, 552, 651, 653, 655, 656, 908–911, 914, 916, 919; 221/175, 176

[56] References Cited

U.S. PATENT DOCUMENTS 1,472,589 10/1923 Ellis ..... 209/924
2,444,751 7/1948 Scott ..... 209/655
3,388,795 6/1968 Beroset et al. ..... 209/907
3,410,453 11/1968 Lawrence ..... 221/175

*Primary Examiner*—William E. Terrell
*Assistant Examiner*—Tamara Kelly
*Attorney, Agent, or Firm*—Merchant, Gould, Smith, Edell, Welter & Schmidt

[57] ABSTRACT

An apparatus for automatically magnetizing pieces cut to have an optional shape and size and sorting magnets magnetized in terms of quality. For the sorting, the apparatus includes a testing station for applying an external magnetic field in the form of pulses or the like to each magnet, sensing a variation in characteristic of the magnet caused by the applied magnetic field, and performing a measurement, an analysis and an evaluation for the characteristic of the magnet. The apparatus also includes a feeding station for separating one from magnets stacked in a supplying station and feeding it to the testing station, and a sorting station for sorting the tested magnet as a good one or as a bad one, based on the test result obtained in the testing station and putting it in a container.

16 Claims, 8 Drawing Sheets

APPARATUS FOR AUTOMATICLALY SORTING PERMANENT MAGNETS

BACKGROUND OF THE INVENTION

The present invention relates to a magnet sorting apparatus for measuring soft and hard magnets cut into optional shapes and sizes and automatically sorting the magnets in accordance with the result of the measurement.

Commercially available magnets have a variety of magnetic surface flux densities in their magnetized state due to subtle differences in the magnet materials. When unsorted magnets are employed in an appliance such as headphone, actuator for compact disc player (CDP) and the like, it contributes to causing a degradation in the quality of the appliance. Therefore, it is required to use magnets exhibiting uniform properties.

FIG. 1 is a circuit diagram illustrating a circuit for measuring a characteristic of a magnetic material.

In the illustrated circuit, voltages $V_1$ and $V_2$ induced across coils $N_1$ and $N_2$ can be derived in accordance with the following equations:

$$V_1 = -N_1 A \frac{dH}{dt} \tag{1}$$

$$V_2 = -N_2 A \frac{dH}{dt} + N_2 A_m \frac{dM}{dt} \tag{2}$$

$$V_0 = V_1 + V_2 = (-N_2 - N_1) A \frac{dH}{dt} + N_2 A_m \frac{dM}{dt} \tag{3}$$

In case of $N_1=N_2$, the above equation (3) can be expressed as follows:

$$V_0 = V_1 + V_2 = N_2 A_m \frac{dM}{dt}$$

$$\frac{dM}{dt} = \frac{V_0}{N_2 A_m}$$

By integrating both parts of the just above equation for t, the following equation is established:

$$\int_{t_0}^{t_n} dM = \int_{o}^{n} \frac{V_0}{N_2 A_m} dt \tag{4}$$

$$\therefore M = \frac{1}{N_2 A_m} \int_0^n V_0 dt + C_1$$

That is, the quantitative magnetization M of a magnet surrounded by the coil $N_2$ can be derived by integrating the signal $V_0$.

By arranging the equation (1) after integrating for t, the following equation is established:

$$\int_{t_o}^{t_n} dH = -\int_0^n \frac{V_1}{N_1 A} dt \tag{5}$$

$$\therefore H = -\frac{1}{N_1 A} \int_0^n V_1 dt + C_2$$

That is, the intensity H of an external magnetic field per field can be derived by integrating $V_1$.

Since the equation (2) corresponds to a state prior to a pulse application, dH/dt is zero (dH/dt=0).

Accordingly, the following equation can be established:

$$M_0(J_0) = \int_0^n \frac{V_2}{N_2 A_m} dt \tag{6}$$

$$\therefore M_0 = \frac{1}{N_2 A_m} \int_0^n V_0 dt + C_2 (\because \text{initial} V_1 = 0)$$

By M-H plotting the results of the equations (4) and (5), an iHc curve shown in FIG. 2 can be obtained.

Since B=H+M, the value of B can be derived by summing the results of the equations (4) and (5). By B–H plotting the result of the summing calculation and the result of the equation (4), a bHc curve shown in FIG. 2 can be obtained.

In the above equations, $V_1$, $V_2$: voltages induced in respective coils;

$V_0$: $V_1$ and $V_2$;

A: cross-sectional area of each coil;

Am: cross-sectional area of magnet;

$N_1$, $N_2$: numbers of turns of respective coils;

M: quantitative magnetization of magnet;

H: intensity of external magnetic field;

t: time;

n: point of time when measurements are completed; and $M_0(J_0)$: initial quantitative magnetization of magnet for a residual magnetic flux density of $B_r$.

By referring to the equations, it can be found that in a general magnetic substance, a magnetic hysteresis phenomenon occurs between a magnetic field externally applied and a quantitative magnetization (spontaneous magnetization) of a magnet.

FIG. 2 is a graph of a hysteresis loop, illustrating only curves of the second quadrant thereof.

By analyzing a characteristic of the second quadrant of the hysteresis loop corresponding to the case wherein a magnetic field externally applied is opposite in direction to line of magnetic force generated from the magnet, the characteristic of the magnet can be found (in hard magnets, more advantageous results may be obtained).

In FIG. 2, the iHc curve shows a relation of "the quantitative magnetization of the magnet itself" to an external magnetic field H whereas the bHc curve shows a characteristic resulted from a consideration of both the characteristic of the magnet itself and the magnetic field externally applied with respect to the external magnetic field H.

The magnetic flux density of the magnet is determined, depending on the shape of the magnet and the environment around the magnet.

Lines determined after taking into consideration the above-mentioned are permeance lines (hereinafter, referred to as "P lines." These lines are shown as lines $P_1$ and $P_2$ in FIG. 2.

The density of magnetic flux generated from the magnet corresponds to the value of B at a point of intersection between the bHc curve and the P line. For example, if the line $P_1$ is assumed as the P line at a bare magnet state, the density of magnetic flux generated from the magnet corresponds to $B_1$.

For employing a magnet in an appliance such as a motor or speaker, generally, a yoke is attached to the magnet for getting the P line closer to the B-axis and thereby increasing the surface magnetic flux density. Assuming the line $P_2$ of FIG. 2 as the P line in this case, the density of magnetic flux generated from the magnet corresponds to $B_2$. That is, the magnetic flux density is increased from $B_1$ to $B_2$.

Values of H at points of intersection between the iHc curve and the H-axis and between the bHc curve and the H-axis in FIG. 2 are indicative of coercive forces for the iHc curve and bHc curve, respectively. These coercive forces are indicated by iHc and bHc, respectively.

Conventionally, evaluation and sorting of magnets exhibiting uniform characteristics are achieved by manually performing measurements of the surface magnetic flux density and the magnetic flux for each magnet at a bare magnet state or at a yoke-attached state by use of a measuring instrument, and then determining, as the total characteristic values of each magnet, characteristic values at one or two points on the hysteresis loop, which points correspond to the measured values.

Since the above-mentioned conventional method carries out the evaluation and sorting of a magnet using only one or two points on the hysteresis loop for the magnet, the surface magnetic density of this magnet may be considerably different from the surface magnetic density $B_2$. This is because only the value $B_1$ on the P line is measured in accordance with the conventional method.

Precise measuring instruments are commercially available, however, these measuring instruments can not be used for quality control because of their low processing speed (one or two days are taken for a measurement) and a low applicable magnetic field of, for example, 20 KOe. The sorting work after completion of the measurement is also manually carried out. As a result, the productivity associated with the sorting is degraded.

SUMMARY OF THE INVENTION

Therefore, an object of the invention is to solve the above-mentioned problems encountered in the prior art and, thus, to provide an apparatus for automatically sorting magnets (capable of sorting only desired magnets from undesired magnets) by measuring and analyzing characteristics of each magnetic with respect to points on a second quadrant of a hysteresis curve of the magnet, and evaluating the measured and analyzed characteristics, and capable of reducing the measurement time and thereby improving the productivity associated with the measurement and the sorting.

In accordance with the present invention, this object can be accomplished by providing an apparatus for automatically sorting permanent magnets, comprising: a supplying station installed on an upper platform and adapted to store a plurality of magnetized samples therein; a feeding station installed on the upper platform and adapted to sequentially separate and feed the samples stored in the supplying station one by one; a testing station installed between the upper platform and a lower platform disposed below the upper platform, the testing station being adapted to measure characteristics of each sample fed from the feeding station; a discharging station installed on the lower platform beneath the testing station and communicated with the testing station, the discharging station being adapted to discharge each sample tested in the testing station; a sorting station adapted to sort each sample discharged out of the discharging station on the basis of the result of the test; and a storing station adapted to receive each sample sorted by the sorting station and store it therein.

BRIEF DESCRIPTION OF THE DRAWINGS

Other objects and aspects of the invention will become apparent from the following description of embodiments with reference to the accompanying drawings in which.

DETAILED DESCRIPTION

Figure 1:
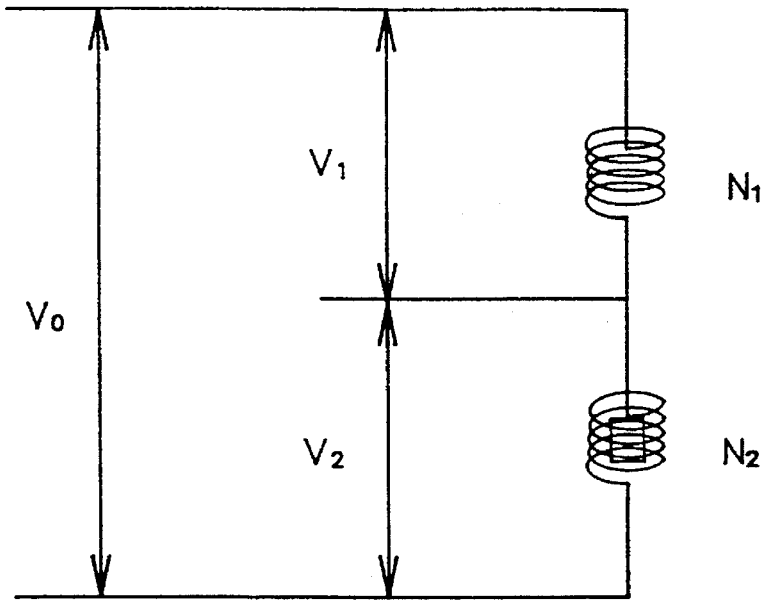
FIG. 1 is a circuit diagram illustrating a circuit for measuring a characteristic of a magnetic material.
Figure 2:
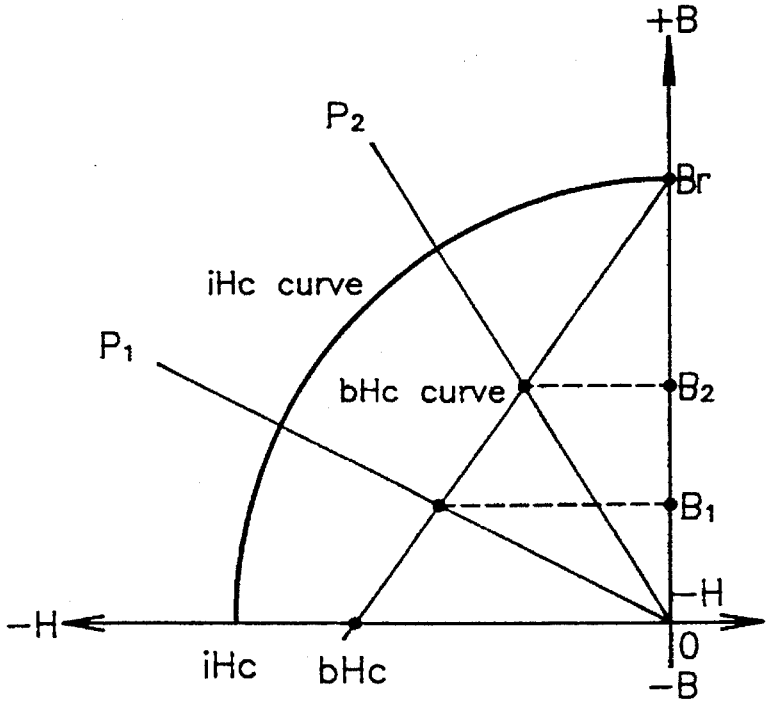
FIG. 2 is a graph of a hysteresis loop, illustrating only curves of the second quadrant thereof.
Figure 3:
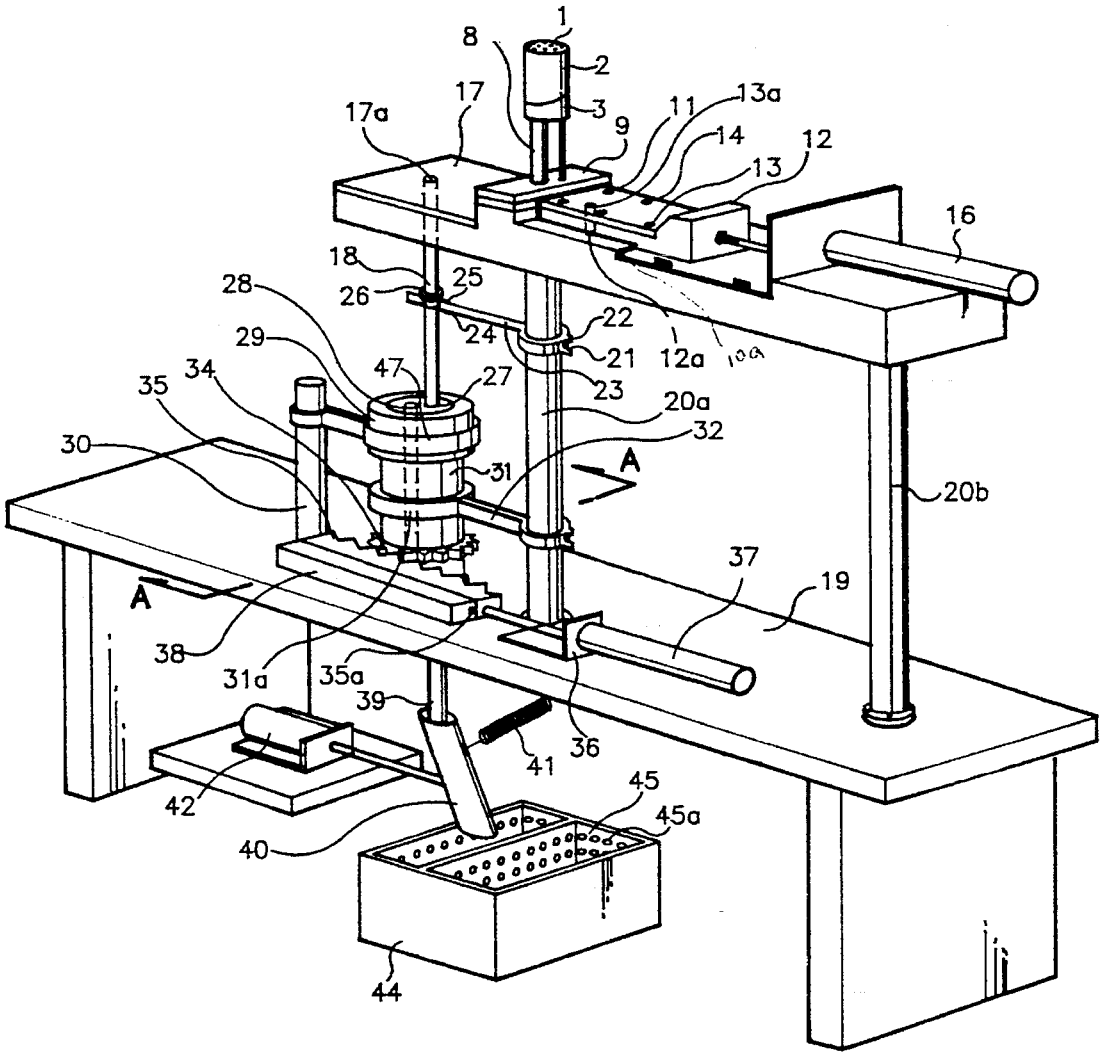
FIG. 3 is a perspective view of an apparatus for automatically sorting magnets in accordance with the present invention.

FIG. 3 is a perspective view of an apparatus for automatically sorting permanent magnets in accordance with the present invention.

The apparatus of the present invention comprises six essential parts, that is, a supplying station, a feeding station, a testing station, a discharging station, a sorting station, and a stacking station. Since the apparatus of the present invention is adapted to test magnetized magnets, elements coming into contact with the magnets are made of a non-magnetic material.

Figure 4:
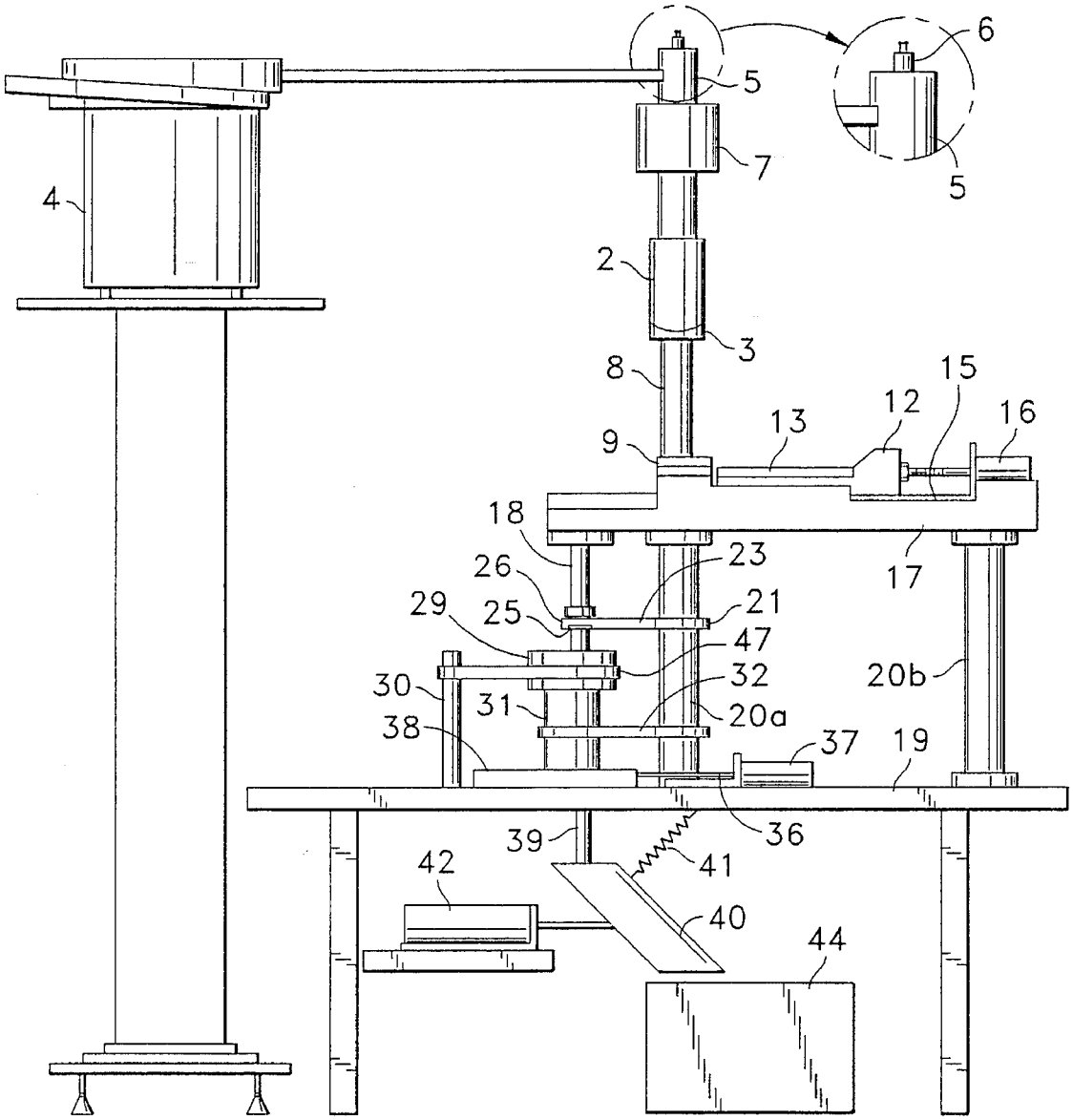
FIG. 4 is a front view of the apparatus shown in FIG. 3, illustrating a part feeder installed in one part of the apparatus.
Figure 5:
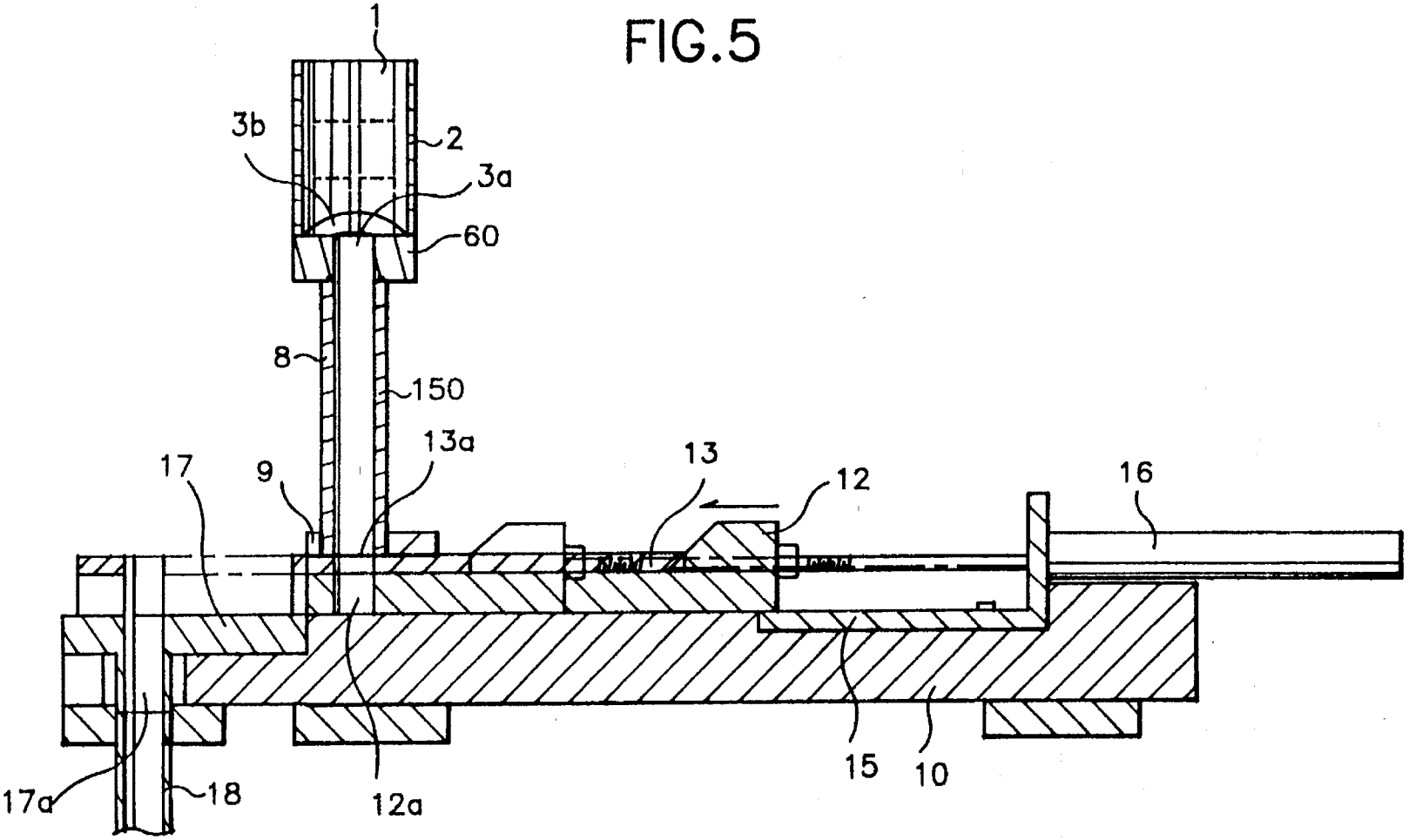
FIG. 5 is a sectional view illustrating a supplying station and a feeding station both included in the apparatus shown in FIG. 3.

The supplying station of the apparatus is shown in FIGS. 3 to 5. The supplying station comprises a sample containing pipe 2 for containing a plurality of magnet samples 1 to be tested in the form of bundles therein. A seat plate 3 is fixed to the lower end of the sample containing pipe 2. The seat plate 3 has a sample supply passage 3*a* for passing a bundle of samples 1 to be tested therethrough.

The samples 1 contained in the sample containing pipe 2 are arranged such that the upper and lower ends of each sample correspond to S-pole and N-pole, respectively. This arrangement is adapted for achieving an automatic feeding of samples by a magnetic attraction. When feeding a bundle of samples 1 through the sample supply passage 3*a* is completed, the uppermost end of the sample bundle discharged out of the sample containing pipe 2 is positioned at the upper end of the sample supply passage 3*a* exposed to the sample storing pipe 2. Since the upper most end of the discharged sample bundle corresponds to S-pole, it attracts the lowermost end, N-pole, of one of sample bundles disposed adjacent to the discharged sample bundle by the magnetic attraction generated therebetween. Accordingly, the sample bundles stacked in the sample containing pipe 2 can be sequentially fed to the next station.

The seat plate 3 may be provided at its upper surface with a guide surface 3*b* inclined downwards toward the sample supply passage 3*a*, as shown in FIG. 5. When one of sample bundles disposed adjacent to the currently discharged sample bundle is attracted by the discharged bundle, it slides along the inclined guide surface 3*b* of the seat plate 3 into the sample supply passage 3*a*. Accordingly, the feeding of samples can be more easily made.

Where non-magnetized samples are initially supplied to the supply station, they should be magnetized before they are contained in the sample containing pipe 2. To this end, a part feeder 4 is provided for sequentially feeding the non-magnetized samples to one side of the supplying station, as shown in FIG. 4. A supply guide 5 is also mounted on the upper end of the sample containing pipe 2. The supply guide 5 is connected to the terminal end of the parts feeder 4. A proximity sensor 6 is disposed at the upper end of supply guide 5. Around the upper portion of supply guide 5, a magnetizing coil 7 is disposed which is adapted to apply a pulsed magnetic field to the interior of the supply guide 5 at predetermined intervals. When there is no magnetized sample in the supply guide 5, the proximity sensor 6 senses this situation and stops a testing operation of the apparatus. Simultaneously, the proximity sensor 6 actuates the part feeder 4 so that non-magnetized samples may be fed to the supply guide 5.

To the lower end of sample supply passage 3*a* provided at the seat plate 3, a sample supply pipe 8 is connected at its upper end. The sample supply pipe 8 communicates with the sample supply passage 3*a* and extends downwards from the sample supply passage 3*a* so as to feed a predetermined number of samples corresponding to the height of the sample supply passage 3*a*.

On the other hand, the feeding station comprises a fixed plate 9 to which the lower end of the sample supply pipe 8 is fixedly mounted. The fixed plate 9 is fixedly mounted to an upper platform 10 and spaced a predetermined distance apart from the upper platform 10 by spacers 11. In one side of the fixed plate 9, a slider 12 having a sample separating hole 12*a* is disposed which can move along the platform 10 between its extended position and its retracted position, as shown in FIG. 5.

A sample separating plate 13 is separably mounted on the slider 12. The sample separating plate 13 has a hole 13*a* aligned with the sample separating hole 12*a* of the slider 12.

The slider 12 is connected to a piston rod of a first cylinder 16 which is fixed to the upper platform 10 by means of a bracket 15. By every stroke of the first cylinder 16, the slider 12 separates one sample received in its sample separating hole 12*a* therefrom while passing through the space defined between the fixed plate 9 and the upper platform 10.

The sample separating plate 13 is in contact with the lower surface of fixed plate 9 at its upper surface and with the spacers 11 respectively at both its side surfaces. The sample separating plate 13 also has an upper surface in contact with the lower surface of fixed plate 9. To guide the sliding movement of the slider 12, the upper platform 19 has guide members 10*a* respectively protruded from its both side edges.

At one side portion of the upper platform 10 opposite to the side portion supporting the slider 12, a sample input pipe 17 is separably mounted on the upper platform 10. The sample input pipe 17 is provided with a sample input passage 17*a* having a diameter larger than that of samples.

The sample supply pipe 8, the spacer 11, the sample separating plate 13 and the sample input plate 17 are replaceable to be proper to the diameter and thickness of samples to be tested.

Figure 6:
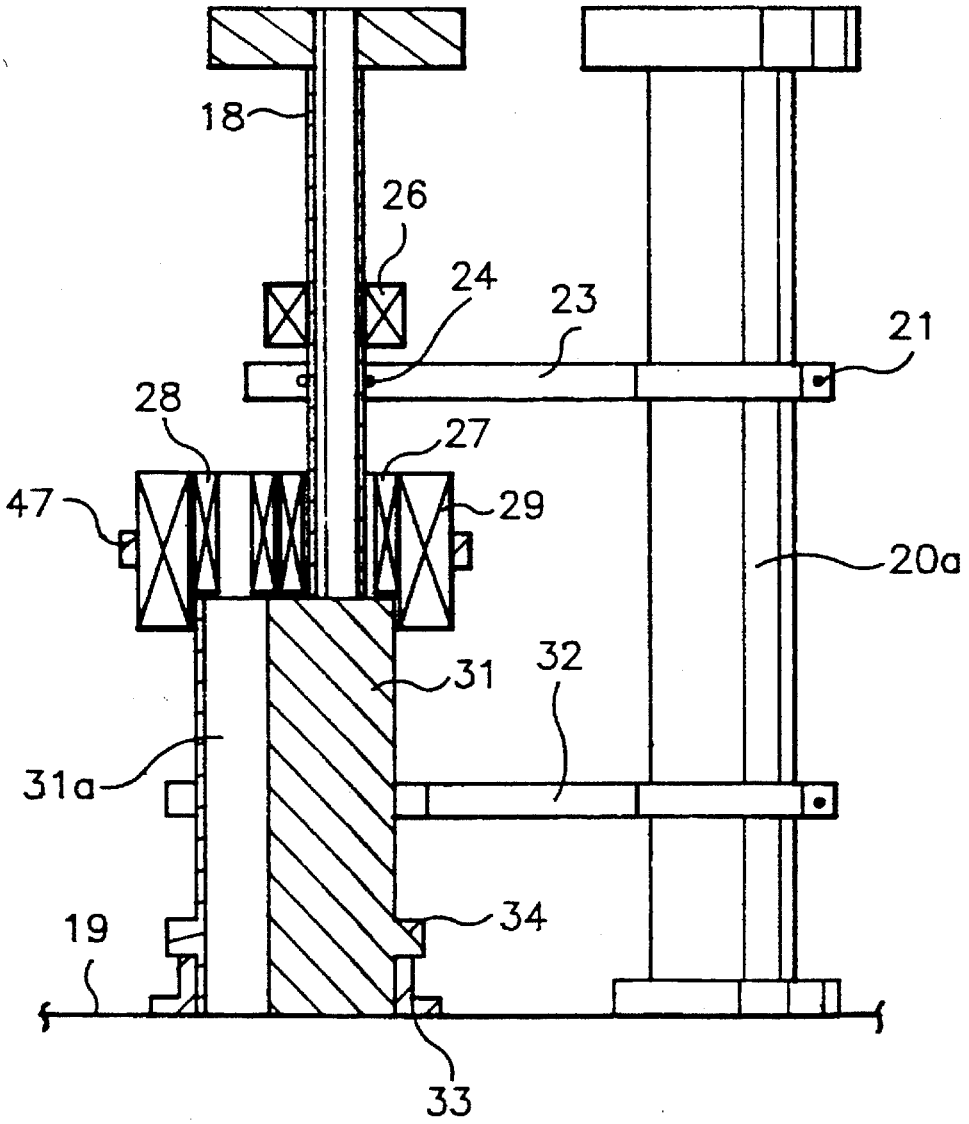
FIG. 6 is a sectional view illustrating a testing station and a discharging station both included in the apparatus shown in FIG. 3.

FIG. 6 is a sectional view illustrating the testing station and the discharging station in accordance with the present invention.

As shown in FIG. 6, a sample input pipe 18 is threadedly coupled at its upper end to the upper platform 10 such that it is aligned with the sample input passage 17*a*. The sample input pipe 18 has a lower end fixedly mounted to a supporting rod 20*a* supporting the upper platform 10 to a lower platform 19, by clamping means.

The clamping means comprises a clamping bar 23 clamped by a bolt 21 and a nut 22, a U-bolt 24 and a nut 25.

A primary sensing coil 26 is mounted around the upper portion of sample input pipe 18. The primary sensing coil 26 serves to detect a voltage induced when a sample passes through the sample input pipe 18 so as to measure an initial magnetization value, based on the detected voltage.

Around the lower end of sample input pipe 18, a secondary sensing coil 27 is disposed which serves to detect a voltage induced when an external magnetic field is reversely applied to an input sample so as to measure a variation in quantitative magnetization, based on the detected voltage.

In one side of the secondary sensing coil 27, a third sensing coil 28 is disposed which serves to detect a voltage induced by the magnetic field externally applied so as to derive the intensity of the magnetic field.

An external magnetic field applying coil 29 is also provided which surrounds both the secondary and third sensing coils 27 and 28. The external magnetic field applying coil 29 applies the pulsed external magnetic field to a sample upon testing the sample.

The second and third sensing coils 27 and 28 are supported by the external magnetic field applying coil 29 which is, in turn, mounted to a fixed rod 30 fixedly mounted to the lower platform 19 by means of a band 47.

The voltages sensed by the primary, secondary and third sensing coils 26, 27 and 28 are subjected to a processing for an integrating operation for waveform to time in an integrating circuit or a computer well known to those skilled in the art. Based on the result of the integrating operation, sample characteristics such as residual magnetic flux density, constant magnetic force, and maximum energy sum are determined.

Where the computer is utilized for the integrating operation for the voltages, it receives signal values via a D/A converter at predetermined intervals, multiplies the magnitude of each signal by the time interval, and accumulates the resultant value. Where the integrating circuit is utilized, a value detected at each time corresponds to a value integrated up to the time.

It can be also understood that a semiconductor device or a programmable logic controller (PLC) may be utilized for the integrating operation for waveform to time.

Now, construction of the discharging station for discharging samples tested as above will be described.

The discharging station comprises a rotation rod 31 rotatably mounted on the lower platform 19, as shown in FIG. 6. The rotation rod 31 has a sample discharging passage 31*a* arranged such that it is not aligned with the sample input pipe 18 at an initial position of the rotation rod 31. A sample 1 fed through the sample input pipe 18 is initially laid on the upper surface of rotation rod 31 so that it can be subjected to a test.

The upper portion of rotation rod 31 is supported by a clamping bar 32 fixedly mounted to the supporting rod 20*a*. On the other hand, the lower portion of rotation rod 31 is rotatably supported by a bearing 33 fixedly mounted on the lower platform 19.

As shown in FIG. 3, a pinion 34 is fitted around the lower portion of rotation rod 31 to be integral with the rotation rod 31. When a testing operation for each sample is completed, the pinion 34 rotates the rotation rod 31 through an angle of 180° so that the sample discharging passage 31*a* can be aligned with the sample input pipe 18, thereby causing the tested sample to be discharged through the sample discharging passage 31*a*. In one side of the pinion 34, a rack 35 is reciprocally disposed which engages with the pinion 34. By the reciprocating movement of rack 35, the rotation of rotation rod 31 is generated. The rack 35 is connected to a reciprocating piston rod of a second cylinder 37. The second cylinder 37 is fixedly mounted to a bracket 36 fixedly mounted on the lower platform 19.

Figure 7:
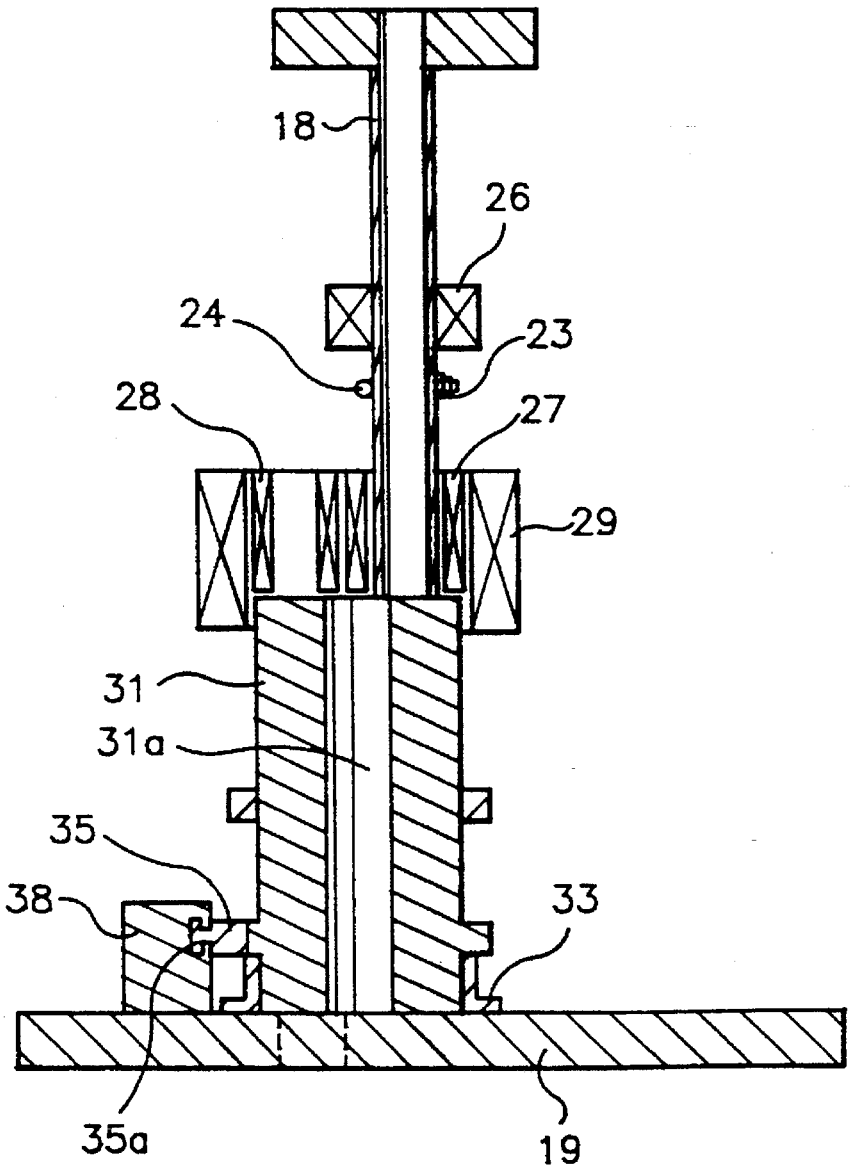
FIG. 7 is a cross-sectional view taken along the line A—A of FIG. 6.

As shown in FIG. 7, the rack 35 has an elongated guide protrusion 35*a* at its one side portion opposite to the rack teeth. A guide rail 38 is also fixedly mounted on the lower platform 19. The guide protrusion 35*a* of rack 35 is slidably engaged in the guide rail 38 so that the rack 35 can slide along the guide rail 38. With such a guide construction, the rack 35 can reciprocate stably as the second cylinder 37 operates.

Preferably, the rotation rod 31 is made of a synthetic resin having a non-magnetic property whereas the pinion 34 is made of a metallic material such as stainless steel. The rotation rod 31 is made of the non-magnetic synthetic resin to prevent the magnetic property of samples from interfering with a smooth feed of the samples. The pinion 34 is made of stainless to prevent the pinion 34 from being worn even after its repeated uses for a long period.

A discharge pipe 39 is fixed to the lower platform 19 such that it is vertically aligned with the sample input pipe 18 of the testing station. When the sample discharging passage 31*a* is aligned with the sample input pipe 18 by the rotation of rotation rod 31 through an angle of 180°, the discharge pipe 39 is aligned with the sample discharging passage 31*a*. As a result, the sample input pipe 18, the sample discharging passage 31*a* and the discharge pipe 39 are aligned with one another, thereby causing the tested sample to be outwardly discharged through the sample discharging passage 31*a* and then the discharge pipe 39.

Figure 8:
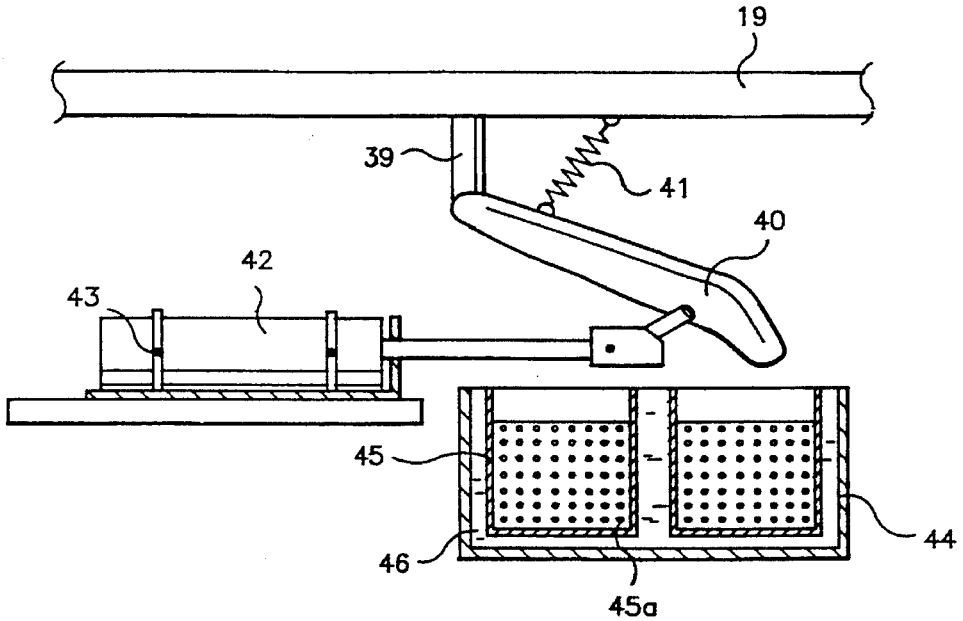
FIG. 8 is a sectional view illustrating a sorting station and a storing station both included in the apparatus shown in FIG. 3.
Figure 9:
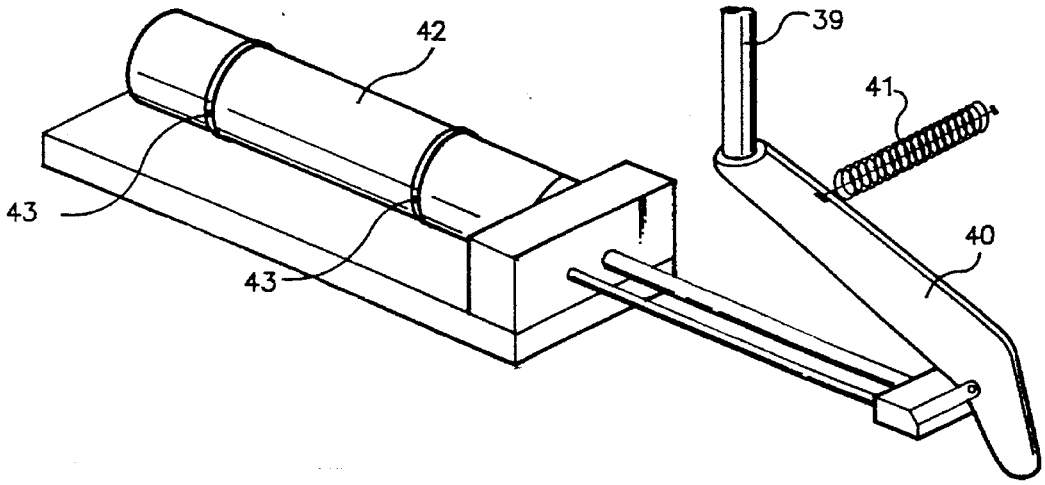
FIG. 9 is a perspective view of the sorting station shown in FIG. 8.

FIG. 8 is a sectional view illustrating the sorting station and the stacking station in accordance with the present invention.

As shown in FIG. 8, the sorting station which performs an operation of sorting the samples in accordance with the measured sample characteristics includes a selection hood 40 pivotally coupled at its upper end to the discharge pipe 39 of the discharging station. The selection hood 40 is coupled at its upper portion to the lower platform 19 by means of a spring 41. The selection hood 40 is also pivotally coupled to a reciprocating piston rod of a third cylinder 42. With such a construction, the selection hood 40 can pivot by the reciprocating movement of piston rod of the third cylinder 42 against the spring force of spring 41. The third cylinder 42 is actuated in accordance with the result of the measurement carried out in the testing station. The actuation of the third cylinder 42 is carried out prior to the rotation of the rotation rod 31 for discharging the tested sample.

At the outer surface of the third cylinder 42, a pair of spaced light emitting diodes (LEDs) 43 are attached. The LEDs 43 emit light selectively in accordance with a position of the selection hood 40 moved by the actuation of the third cylinder 42, thereby enabling a user to see the position of the selection hood 40 with the naked eye.

Construction of the stacking station for receiving the sorted samples from the selection hood 40 of the sorting station and storing them will now be described.

The stacking station includes a container 44 having a box construction opened at its upper end. The container 44 is disposed beneath the selection hood 40. In the container 44, a pair of sorting boxes 45 are separably received. Each sorting box 45 is opened at its upper end and provided with small apertures 45*a*. In the container 44, an oil is also contained which is kept at a temperature of 250° to 450° C. The reason why the apertures 45*a* are provided at each sorting box 45 is to permit the oil 46 to be introduced into the sorting box 45. Also, the reason why the oil 46 of 250° to 450° C. is contained in the container 44 is to prevent each sample subjected to the test from exerting its magnetic force and thereby prevent the sample from being struck against and thereby broken by a sample already contained in a corresponding sorting box 45 due to an attraction generated therebetween, when it drops into the sorting box 45.

As apparent from the above description, the sorting apparatus of the present invention is constructed to contain a plurality of sample bundles in the sample containing pipe 2 at an initial state, feed each sample of each sample bundle to the sample separating hole 12*a* via the sample supply pipe 8, and then initiate the sorting operation under a condition that one sample is contained in the sample separating hole 12*a*. This operation of the sorting apparatus will now be described.

Figure 10:
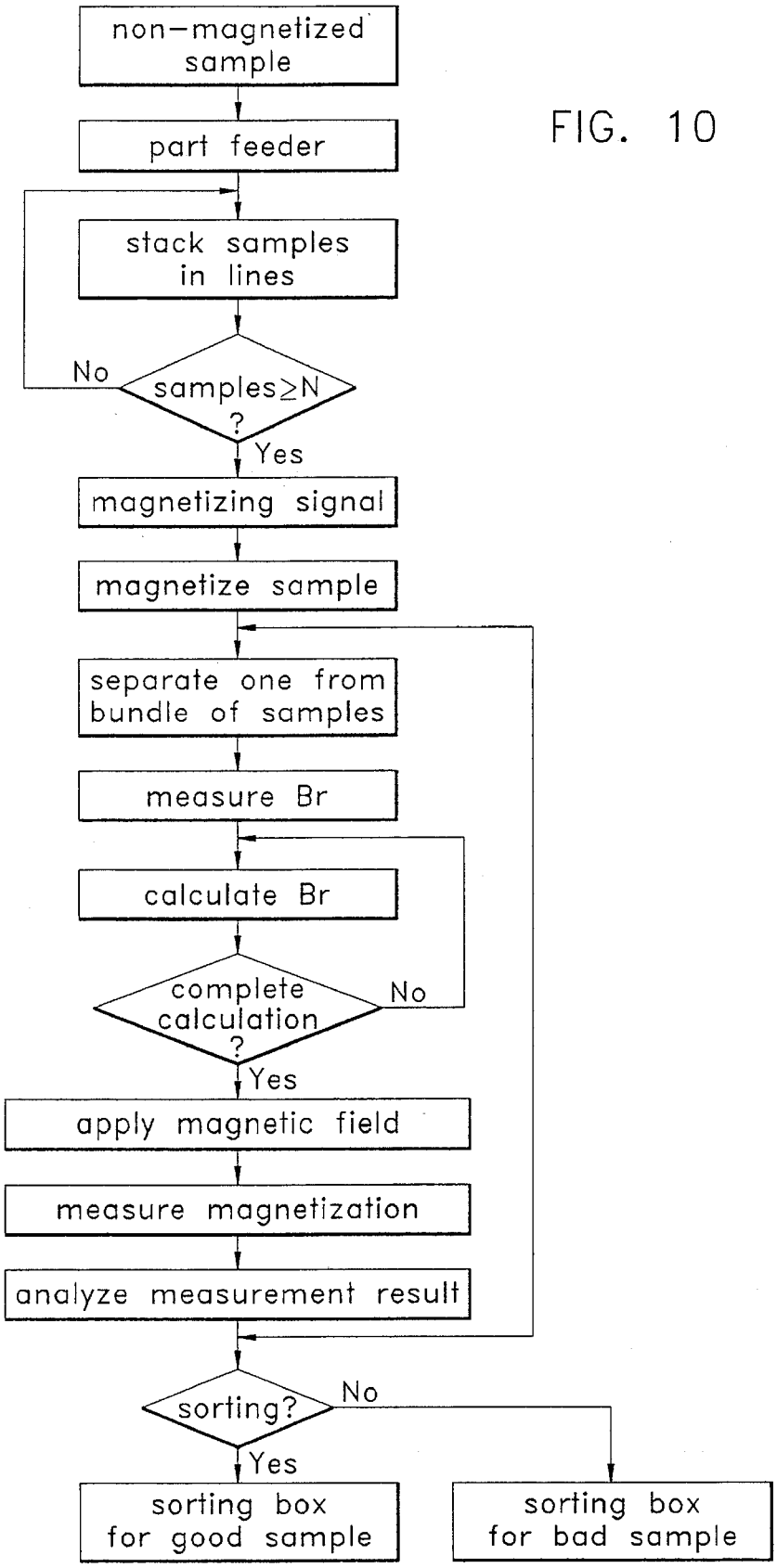
FIG. 10 is a flow chart illustrating the overall operation of the apparatus of FIG. 3 in accordance with the present invention.

FIG. 10 is a flow chart explaining the operation of the sorting apparatus in accordance with the present invention.

When the part feeder 4 installed in one side of the sorting apparatus operates under a condition that any magnetized sample has not been introduced in the sample containing pipe 2 yet, non-magnetized samples from the part feeder 4 are sequentially fed to the supply guide 5 and then stacked in a line in the supply guide 5.

When the number of samples fed to the supply guide 5 is sensed to be N by a sensor (not shown), a magnetization signal is applied to the magnetizing coil 7 which, in turn, generates pulse signals for magnetizing the samples. As a result, magnetization of the samples is achieved.

In either case of testing non-magnetized samples after magnetization as mentioned above or of testing magnetized samples, the samples are contained in the form of bundles in the sample containing pipe 2 such that each sample in each bundle is arranged to have S-pole at its upper end and N-pole at its lower end.

Thereafter, a lower part of one sample bundle from the sample containing pipe 2 is automatically introduced in the sample supply pipe 8, by virtue of its weight, through the sample supply passage 3*a* provided at the lower end of sample containing pipe 2. When the sample bundle is contained at its lower part in the sample supply pipe 8, the lowermost sample thereof is received in the sample separating hole 12*a* of the slider 12. After the sample is contained in the sample separating hole 12*a*, a testing operation is initiated.

That is, the first cylinder 16 fixedly mounted to the bracket 15 is actuated under the above-mentioned condition so as to move the slider 12 to its left position indicated by a dotted line in FIG. 5. By this left movement of the slider 12, the sample received in the sample separating hole 12*a* is separated from the sample bundle contained in the sample supply pipe 8. Upon separating the lowermost sample of the sample bundle, the remaining samples of the sample bundle are not shifted because the sample positioned just above the lowermost sample being separated is supported by the upper surface of the sample separating plate 13.

When the slider 12 reaches its left position, the sample separating hole 12*a* is aligned with the sample input passage 17*a* of the sample input plate 17, thereby causing the sample contained in the sample separating hole 12*a* to drop into the sample input pipe 18 by its weight.

After completing the feeding of one separated sample to the sample input pipe 18 via the sample input passage 17*a*, the first cylinder 16 returns to its original state so as to move the slider 12 to its initial position, that is, its right position.

when the slider reaches its right position, the sample separating hole 12*a* is aligned with the sample supply pipe 8. As a result, the sample bundle contained in the sample supply pipe 8 is shifted downwards toward the sample separating hole 12*a* by its weight such that the lowermost one of remaining samples of the sample bundle is received in the sample separating hole 12*a*.

As the slider 12 operates repeatedly, remaining samples of the sample bundle are sequentially fed to sample input pipe 18. When feeding of the sample bundle through the sample supply passage 3*a* is completed, the upper surface of the uppermost sample of the sample bundle discharged out of the sample containing pipe 2 is flush with the upper surface of the seat plate 3. Since the upper surface of the uppermost sample corresponds to S-pole, it attracts the lower surface, N-pole, of the lowermost sample of one of sample bundles disposed adjacent to the discharged sample bundle by the magnetic attraction generated therebetween. As a result, the attracted sample bundle is vertically aligned with the discharged sample bundle. In accordance with this principle of the present invention, the sample bundles contained in the sample containing pipe 2 can be sequentially fed to the sample input pipe 18.

When one of sample bundles disposed adjacent to the currently discharged sample bundle is attracted by the discharged sample bundle, it slides along the included guide surface 3*b* of the seat plate 3 into the sample supply passage 3*a* by virtue of its weight. Accordingly, the feeding of samples can be more easily made.

As one sample from the supplying station is dropped into the sample input pipe 18 by the operation of the feeding station, it passes through the primary sensing coil 26 disposed around the upper portion of sample input pipe 18, as shown in FIG. 6. The primary sensing coil 26 detects a voltage inducted when the sample passes through the sample input pipe 18 and measures the initial magnetization value, namely, the residual magnetic flux density ($B_r$) of the sample, based on the detected voltage. The voltage induced in the primary sensing coil 26 has the form of a sine wave of substantially one cycle. Accordingly, the residual magnetic flux density can be derived by integrating the waveform of positive or negative with respect to time by use of any integrating circuit or a computer.

As the sample subjected to the measurement of the residual magnetic flux density comes to the lower end of sample input pipe 18, it is laid on the upper surface of rotation rod 31 because the rotation rod 3 is maintained at a position where the sample discharging passage 31*a* has a phase difference of 180° from the sample input pipe 18.

At this state, a reverse magnetic field from the external magnetic field applying coil 29 is applied to the sample laid on the rotation rod 31. The secondary sensing coil 27 detects a variation in quantitative magnetization of the sample caused by the applied reverse magnetic field, in the form of voltage. Accordingly, the variation in quantitative magnetization of the sample can be derived by performing an integrating operation for the voltage, as in the above-mentioned case of measuring the residual magnetic flux density.

Upon measuring the characteristics of the sample as above, the external magnetic field applying coil 29 disposed around the lower portion of sample input pipe 18 generates a pulsed voltage for applying the magnetic field to the sample. The third sensing coil 28 disposed in one side of the secondary sensing coil 27 and surrounded by the external magnetic field applying coil 29 detects the intensity of the magnetic field externally applied from the external magnetic field applying coil 29.

Since the external magnetic field is applied in the form of pulses (about 1,000 to 10,000 μsec), the time taken for the measurement is very short and, thus, the processing speed is very high. As a result, it is possible to establish a magnetic field having a high intensity of, for example, not less than 30 KOe.

After completing the measurement of characteristics for one sample in the testing station, the computer analyzes the result of the measurement and sorts the sample, based on the result of the analysis.

For sorting the sample, the third cylinder 42 is actuated in accordance with the result of analysis from the computer. By the actuation of the third cylinder 42, the selection hood 40 connected to the discharge pipe 39 moves pivotally such that its outlet is positioned above a selected one of sorting boxes 45 contained in the container 44.

At this time, one of LEDs 43 corresponding to the selected sorting position of the selection hood 40 emits light. Accordingly, the user can see with the naked eye whether the sample is sorted as a good one or as a bad one.

After completing the pivotal movement of the selection hood 40 to the selected sorting position determined on the basis of the result of the test, the second cylinder 37 fixedly mounted on the lower platform 19 by the bracket 36 is actuated. By the actuation of the second cylinder 37, the rack 35 connected to the piston rod of the second cylinder 37 slides along the guide rail 38, thereby causing the pinion 34 engaging with the rack 35 to rotate. Since the rack 35 is guided by the guide rail 38, its sliding movement is stably carried out. The sliding length of rack 35 should be precisely determined depending on the diameter of the rotation rod 31 so that the pinion 34 and the rotation rod 31 can rotate through an angle of 180°.

When the rotation rod 31 rotates 180° from the state of FIG. 7 by the sliding movement of rack 35, the sample discharging passage 31*a* of rotation rod 31 is vertically aligned with both the sample input pipe 18 and the discharge pipe 39. As a result, the sample disposed at the lower end of sample input pipe 18 is outwardly discharged via the sample discharging passage 31*a*, the discharge pipe 39 and then the selection hood 40, and finally received in the selected sorting box 45.

Thereafter, both the second cylinder 37 and the third cylinder 42 return to their original states, respectively. As a result, the sample discharging passage 31*a* has the phase difference of 180° from the sample input pipe 18 again, whereas the selection hood 40 is maintained such that its outlet is positioned above the first sorting box 45.

Since the oil 46 of 250° C. to 450° C. is contained in the container 44, it is possible to prevent the sample from exerting its magnetic force and thereby prevent the sample from being struck against and thereby broken by a sample already contained in the sorting box 45 due to an attraction generated therebetween, when it drops into the sorting box 45.

Hereinbefore, the operation of the sorting apparatus in accordance with the present invention has been described, in conjunction with one cycle including the steps of separating one sample from samples stacked in the supplying station by the feeding station, feeding it to the testing station, testing it, sorting it as a good one or as a bad one, and then putting it in the container. Those skilled in the art will appreciate that the above operation is repeatedly carried out until all samples contained in the sample containing pipe 2 are sorted.

As apparent from the above description, the present invention provides the following advantages.

First, since the magnetic field applied upon testing each magnet has the form of pulses, a high intensity of magnetic field can be obtained without overloading a pulse generator used.

Second, the time taken for the measurement is very short by virtue of the pulsed magnetic field and, thus, the processing speed is very high.

Third, appliances employing the magnets sorted in accordance with the present invention can have a stable quality because all characteristics of each magnet are evaluated.

Fourth, since the magnets to be tested and sorted have a block shape which is, in turn, cut into desired sizes to be used, it is possible to reduce the time taken for the measurement and provide a uniformity in quality.

Fifth, the time taken for the magnets to be machined is greatly reduced because the magnets are tested at a state that they have a shape prior to the cutting into the shape to be practically employed, without any machining for the test.

Sixth, the productivity associated with the measurement and the sorting can be improved because the measurement and the sorting can be simultaneously achieved.

Although the preferred embodiments of the invention have been disclosed for illustrative purposes, those skilled in the art will appreciate that various modifications, additions and substitutions are possible, without departing from the scope and spirit of the invention as disclosed in the accompanying claims.

For example, a pair of LEDs and a pair of sorting boxes are provided for sorting samples into two kinds, namely good ones and bad ones in the illustrated preferred embodiment of the present invention. However, more LEDs and more sorting boxes may be employed where a more detailed sorting is required.

What is claimed is:

1. An apparatus for automatically sorting permanent magnets, comprising:

a supplying station installed on an upper platform of the apparatus for storing a plurality of magnetized samples therein;

a supply guide fixedly mounted to an upper end of the supplying station, the supply guide communicating with the supplying station;

a magnetizing coil disposed around the supply guide;

a part feeder disposed in one side of the supply guide for sequentially feeding non-magnetized samples to the supply guide;

a feeding station installed on the upper platform of the apparatus for sequentially separating and feeding the magnetized samples stacked in the supplying station;

a testing station installed between the upper platform and a lower platform of the apparatus for measuring characteristics of each sample fed from the feeding station;

a discharging station installed on the lower platform of the apparatus beneath the testing station and communicated with the testing station, for discharging each sample tested in the testing station;

a sorting station for sorting each sample discharged out of the discharging station on the basis of the result of the test; and a storing station for receiving and storing each sample sorted by the sorting station.

2. An apparatus in accordance with claim 1, wherein the supplying station comprises:

a vertically extending sample containing pipe for containing the samples in a stacked state therein;

a seat plate for closing a lower end of the sample containing pipe and provided with a sample supply passage for discharging a bundle of stacked samples from the sample containing pipe; and a sample supply pipe fixedly mounted between the seat plate and a fixed plate mounted on the upper platform of the apparatus such that it is vertically aligned with the sample supply passage of the seat plate and provided with a lower end vertically spaced a predetermined distance apart from the upper platform, for supplying the samples one by one from the lower end thereof to the feeding station.

3. An apparatus in accordance with claim 2, further comprising a proximity sensor disposed at an upper end of the supply guide for sensing a state when the number of samples contained in the supply guide is less than a predetermined number and stop a testing operation of the apparatus upon sensing the state.

4. An apparatus in accordance with claim 2, wherein the seat plate has at an upper surface thereof a guide surface inclined downwards toward the sample supply passage.

5. An apparatus in accordance with claim 1, wherein the feeding station comprises:

a fixed plate fixedly mounted on the upper platform of the apparatus by spacers such that it is spaced a predetermined distance apart from the upper platform for supporting a lower end of a sample supply pipe equipped in the supplying station;

a slider disposed on the upper platform of the apparatus to slide along the upper platform between an extended position and a retracted position and provided with a sample separating hole aligned with the sample supply pipe at the retracted position of the slider;

a sample separating plate mounted on the slider and provided with a hole aligned with the sample separating hole of the slider and with an upper surface being in contact with a lower surface of the fixed plate;

a cylinder fixedly mounted to the upper platform by a bracket for sliding the slider; and a sample input pipe mounted on the upper platform and provided with a sample input passage aligned with the sample separating hole of the slider at the extended position of the slider.

6. An apparatus in accordance with claim 5, wherein the spacers and the sample separating plate are separably disposed between the fixed plate and the upper platform.

7. An apparatus in accordance with claim 1, wherein the testing station comprises:

a sample input pipe for guiding each sample fed by the feeding station;

a primary sensing coil disposed around an upper portion of the sample input pipe for detecting a voltage induced when each sample passes through the sample input pipe to thereby measure an initial magnetization value, based on the detected voltage;

a secondary sensing coil disposed around a lower end of the sample input pipe for detecting a voltage induced when an external magnetic field is reversely applied to each input sample to thereby measure a variation in quantitative magnetization, based on the detected voltage;

a third sensing coil disposed in one side of the secondary sensing coil for detecting a voltage induced by the external magnetic field to thereby measure a variation in intensity of the external magnetic field;

an external magnetic field applying coil disposed to surround both the secondary and third sensing coils for applying the external magnetic field to the input sample upon testing; and a computer for integrating the voltages detected by the primary, secondary and third sending coils.

8. An apparatus in accordance with claim 7, wherein the sample input pipe is firmly fixed to a supporting rod, wherein the supporting rod is fixed between the upper platform and the lower platform, by a clamping bar and a clamping member.

9. An apparatus in accordance with claim 1, wherein the discharging station comprises:

a rotation rod disposed to extend downwards from the upper platform and rotate between an initial position and a rotated position, the rotation rod having a sample discharging passage not communicating with an outlet of the testing station at the initial position of the rotation rod, but communicating with the outlet at the rotated position of the rotation rod;

a pinion fitted around a lower portion of the rotation rod to be integral with the rotation rod;

a rack disposed to engage with the pinion;

a cylinder for reciprocating the rack and to thereby rotate the pinion; and a discharge pipe fixedly mounted on the lower platform such that it is vertically aligned with the outlet of the testing station.

10. An apparatus in accordance with claim 9, further comprising guide means for guiding the reciprocal movement of the rack, the guide means comprises a guide rail fixedly mounted on the lower platform and a guide protrusion provided at the rack and slidably received in the guide rail.

11. An apparatus in accordance with claim 9, wherein the rotation rod is fixed to a supporting rod wherein the supporting rod is fixed between the upper platform and the lower platform by a clamping bar and rotatably supported at a lower portion thereof by a bearing fixedly mounted on the lower platform.

12. An apparatus in accordance with claim 9, wherein the rotation rod is made of a non-magnetic material and the pinion is made of a metallic material.

13. An apparatus in accordance with claim 12, wherein the rotation rod is made of a synthetic resin material and the pinion is made of a stainless steel.

14. An apparatus in accordance with claim 1, wherein the sorting station comprises:

a selection hood pivotally disposed beneath the lower platform to communicate with an outlet of the discharging station and resiliently supported to the lower platform by a spring; and a cylinder connected to a lower portion of the selection hood for pivoting the selection hood to a desired position on the basis of a test result obtained in the testing station.

15. An apparatus in accordance with claim 1, wherein the storing station comprises:

a box type container exposed to an outlet of the sorting station;

a plurality of sorting boxes received in the container, each of the sorting box having a plurality of apertures; and an oil contained in the container.

16. An apparatus in accordance with claim 15, wherein the oil contained in the container is kept at a temperature of 250° to 450° C.

* * * * *